United States Patent [19]

Edgar et al.

[11] 4,061,122

[45] Dec. 6, 1977

[54] SPARK PLUG

[76] Inventors: Robert G. Edgar; Miriam E. Edgar, both of 4871 Geneva Ave., Concord, Calif. 94521

[21] Appl. No.: 647,352

[22] Filed: Jan. 8, 1976

[51] Int. Cl.[2] ..... F02P 13/00; F02P 23/00; H01T 13/00; H01T 13/20

[52] U.S. Cl. ..... 123/169 R; 123/169 EL; 123/143 R; 313/118; 313/141

[58] Field of Search ..... 123/143 R, 143 B, 169 R, 123/169 EL, 169 EB, 169 EC, 169 P, 169 PA; 313/118, 130, 141

[56] References Cited

U.S. PATENT DOCUMENTS

| | | | |
|---|---|---|---|
| 1,335,793 | 4/1970 | Olson | 313/141 |
| 1,448,215 | 3/1923 | Hasbrouch | 123/143 R |
| 1,680,058 | 8/1928 | Merica et al. | 313/141 |
| 1,943,027 | 1/1934 | Ratezzana et al. | 123/169 EL |

FOREIGN PATENT DOCUMENTS

| | | | |
|---|---|---|---|
| 61,972 | 6/1955 | France | 313/118 |

*Primary Examiner*—Ronald H. Lazarus
*Assistant Examiner*—Parshotam S. Lall
*Attorney, Agent, or Firm*—Paul B. Fihe

[57] ABSTRACT

A spark plug generally similar to standard design including a body member supporting a pair of electrodes to provide a spark gap in the combustion chamber of an internal combustion engine, the side electrode carrying a projecting extension outside the spark gap but still within the flame ignition and combustion zone of the engine so as to provide a reaction member which enhances the action of catalytic agents in the fuel or alternatively incorporated in the reaction member, itself.

1 Claim, 2 Drawing Figures

SPARK PLUG

FIELD OF THE INVENTION

The present invention relates to spark plugs for internal combustion engines and more particularly, to a spark plug arranged to enhance combustion through the utilization of various catalytic agents.

BACKGROUND OF THE INVENTION

A large number of catalytic agents have been added to gasolines in an effort to increase combustion efficiency and ultimately reduce the production of unburned hydrocarbons, carbon monoxide, the oxides of nitrogen and other smog constituents. For example, boron compounds such as butyl borate and octyl borate are common fuel additives and, more recently, manganese compounds such as methyl cyclopentadienyl manganese tricarbonyl as described in U.S. Pat. No. 2,839,552 and other manganese compounds as described in a later U.S. Pat. No. 3,030,195 have been utilized to function as antiknock agents enabling the reduction of the tetraethyl lead. Quite recently, my own experimentations have indicated that certain particular combinations of boron and manganese additives provide a synergistic effect leading, for example, to the reduction of the oxides of nitrogen by as much as 40 percent according to results of tests by the California Air Resources Board. Theoretically, it would appear that such combination of catalytic agents reduces the activation temperature of carbon, thus allowing engines to run smoother with greater power, eliminate detonation, and reduce the output of smog. Careful observations of of the spark plugs used with such catalytic additive gasolines indicate initial condensing and subsequent eluting of the catalytic agents on the plug electrodes within the combustion zone of the engine.

SUMMARY OF THE PRESENT INVENTION

It is the general objective of the present invention to provide a spark plug modified in a fashion to enhance the catalytic reactions in the combustion zone of an internal combustion engine thus ultimately improving power output and combustion efficiency and reducing the production of smog.

In accordance with such objective, a reaction member is supported in the flame ignition and combustion zone of the engine so as to provide a greater area upon which the catalytic agents may condense and subsequently elute. More particularly, such reaction member can, if a gasoline including the catalytic agents of the type mentioned above is employed, take the simple form of a coil of wire, an S-shaped member or other configuration which maximizes the area of condensation and elution without at the same time interferring with the proper flame propagation during combustion. It is preferred to support such reaction member from the side electrode of an otherwise standard spark plug so that no variation in the plug construction will be necessary, the existent spark gap being retained, and the reaction member being supported immediately opposite such gap so as to lie fully within the combustion zone but not in the gap itself.

If, on the other hand, gasoline without the mentioned additives is employed, the reaction member itself can be constructed to incorporate the mentioned boron and manganese materials or other catalytic agents found desirable so that the efficiency of combustion resultant from the use of such additives will be experienced with such standard fuel.

BRIEF DESCRIPTION OF THE DRAWING

The stated objective of the invention and the manner in which it is achieved, as summarized hereinabove, will be more readily understood by reference to the following detailed description of the exemplary embodiments of the invention shown in the accompanying drawing wherein.

DETAILED DESCRIPTION OF THE EXEMPLARY EMBODIMENTS OF THE INVENTION

Figure 1:
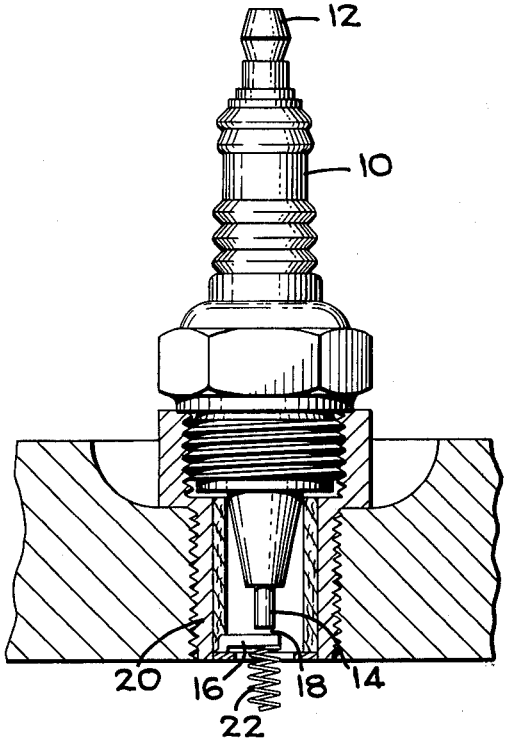
FIG. 1 is an elevational view of a spark plug embodying the present invention mounted in the combustion chamber of an internal combustion engine, the lower portion of the structure being broken away and shown in section to illustrate details of the inventive arrangement.

With initial reference to FIG. 1, the major portion of the illustrated spark plug is of standard design including a body member 10 composed of porcelain or other insulating material and having a terminal 12 at its upper end connected to the internal central electrode 14 of the plug whose lower extremity projects centrally into the combustion chamber of the engine. The second or side electrode 16 which with the first electrode forms the spark gap 18 of the plug within the engine combustion chamber is carried from a metal shell 20 forming a part of the body member of the plug and suitably threaded for screwed connection into the receiving socket of the engine. The general arrangement as thus far described is standard and, in and of itself, forms no part of the present invention.

In accordance with the present invention, a reaction member 22 in the form of a rigid metal coil is welded or otherwise secured to the undersurface of the side electrode 16 of the plug so as to extend downwardly in a helical configuration into the zone immediately beneath the spark gap 18 thus to lie within the flame ignition and combustion zone of the engine. The particular coil configuration provides a large exposed area within the combustion zone but on the other hand is sufficiently open so that no interference with propagation of the flame during combustion will be experienced.

If a gasoline containing boron and manganese compounds as catalytic additives is delivered into the combustion chamber from the engine carburetor, the mentioned synergistic effect of such catalytic additives enhances the combustion and at the termination of a combustion cycle some of the additive material condenses on the plug electrodes 14, 16 and also on the reaction member 22. Upon initiation of the next ignition, the catalytic additives elute from the plug electrodes 14, 16 and the reaction member 22 and because of the extensive area of the latter, enhance engine operation. The following table indicates the comparative results of a standard spark plug and the spark plug incorporating the reaction member 22 as described hereinabove.

| | STANDARD SPARK PLUG | | | | MODIFIED SPARK PLUG | | | |
|---|---|---|---|---|---|---|---|---|
| | BHP | | | | BHP | | | |
| | 40 mph | 50 mph | 60 mph | Avg. | 40 mph | 50 mph | 60 mph | Avg. |
| Untreated Gasoline | 36 | 40 | 38 | 38 | 36 | 40 | 38 | 38 |
| Same + 10 ppm Mn + 10 ppm B | 41 | 44 | 40 | 41.3 | 42 | 44 | 42 | 42.7 |
| Same + 40 ppm Mn + 40 ppm B | 38 | 43 | 42 | 41 | 42 | 44 | 44 | 43.3 |

Initially, it will be observed that if gasoline without the mentioned additives was used as a fuel, no change in the brake horsepower (BHP) was observed when a standard spark plug was replaced by a plug utilizing the described reaction member 22. On the other hand when boron and manganese additives were added in relatively small amounts (10 parts per million) or slightly larger amounts (40 parts per million), the synergistic effects of the condensing and subsequent eluting of the catalytic agents effected an increase of brake horsepower averaging approximately five percent.

Figure 2:
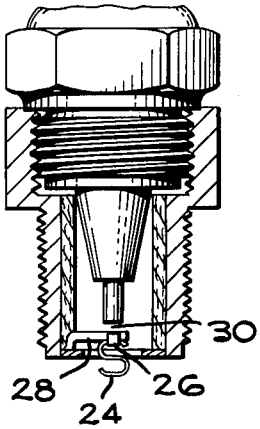
FIG. 2 is an enlarged sectional view of the lower portion of a spark plug constituting a modified embodiment of the invention.

If gasoline without additives is being utilized, the same synergistic effect can be achieved by a reaction member 24 as shown in FIG. 2 which itself incorporates the manganese and boron compounds or other catalytic agents as may be desired. In such embodiment, the reaction member 24 is illustrated as having an S configuration with a small spring clip 26 at its upper extremity enabling its replaceable attachment to the side electrode 28 of the spark plug at a position so that no variation in the spark gap 30 of the plug results. In this embodiment, the reaction member 24 incorporates within itself the boron and manganese additives which may be deposited on an S shaped metal base either from a molten bath or any other source. Upon the occasion of each firing cycle, the small amount of the additives elute from the reaction member 24 to enhance the combustion as mentioned hereinabove.

Yet many other modifications and alternations can be envisioned without departing from the spirit of the invention and the foregoing description of two embodiments is accordingly considered as purely exemplary and not in a limiting sense and the actual scope of the invention is to be indicated only by reference to the appended claims.

What is claimed is:

1. A spark plug for an internal combustion engine which comprises a body member, a pair of electrodes supported by said body member to provide a spark gap in the combustion chamber of the engine, and a reaction member supported adjacent said spark gap so as to lie within the flame ignition and combustion zone of the engine, said reaction member including catalytic agents including a mixture of boron and manganese compounds.

* * * * *